United States Patent [19]

Rozmus

[11] 4,094,709

[45] June 13, 1978

[54] METHOD OF FORMING AND SUBSEQUENTLY HEAT TREATING ARTICLES OF NEAR NET SHAPED FROM POWDER METAL

[75] Inventor: Walter J. Rozmus, Birmingham, Mich.

[73] Assignee: Kelsey-Hayes Company, Romulus, Mich.

[21] Appl. No.: 767,522

[22] Filed: Feb. 10, 1977

[51] Int. Cl.[2] ..... B22F 1/00

[52] U.S. Cl. ..... 148/126; 75/226; 75/200

[58] Field of Search ..... 148/126; 75/226, 200

[56] References Cited

U.S. PATENT DOCUMENTS

| | | | |
|---|---|---|---|
| 3,622,313 | 11/1971 | Havel | 75/226 |
| 3,940,268 | 2/1976 | Catlin | 75/226 |
| 3,992,200 | 11/1976 | Chandholz | 75/226 |

OTHER PUBLICATIONS

Metals Handbook, 1948, Ed. p. 420.

Metals Handbook, vol. pp. 645 & 646, 1961.

*Primary Examiner*—Brooks H. Hunt

*Attorney, Agent, or Firm*—McGlynn and Milton

[57] ABSTRACT

This invention relates to a method of forming and subsequently heat treating articles of near net shape from powder metal which includes the steps of producing a thickwalled container by forming a cavity of predetermined shape in a mass of suitable container material such that the walls of the container are of sufficient thickness so that the exterior surface thereof does not closely follow the contour of the cavity, filling the container with powder metal, applying heat and pressure to the container such that the container material acts like a fluid to apply hydrostatic pressure to the heated powder contained in the cavity thereby consolidating the powder metal to produce a densified compact, preparing the densified compact for heat treating by selectively removing portions of the container to form a jacket of container material around the densified compact, heat treating the densified compact and completing removal of the container material.

6 Claims, 1 Drawing Figure

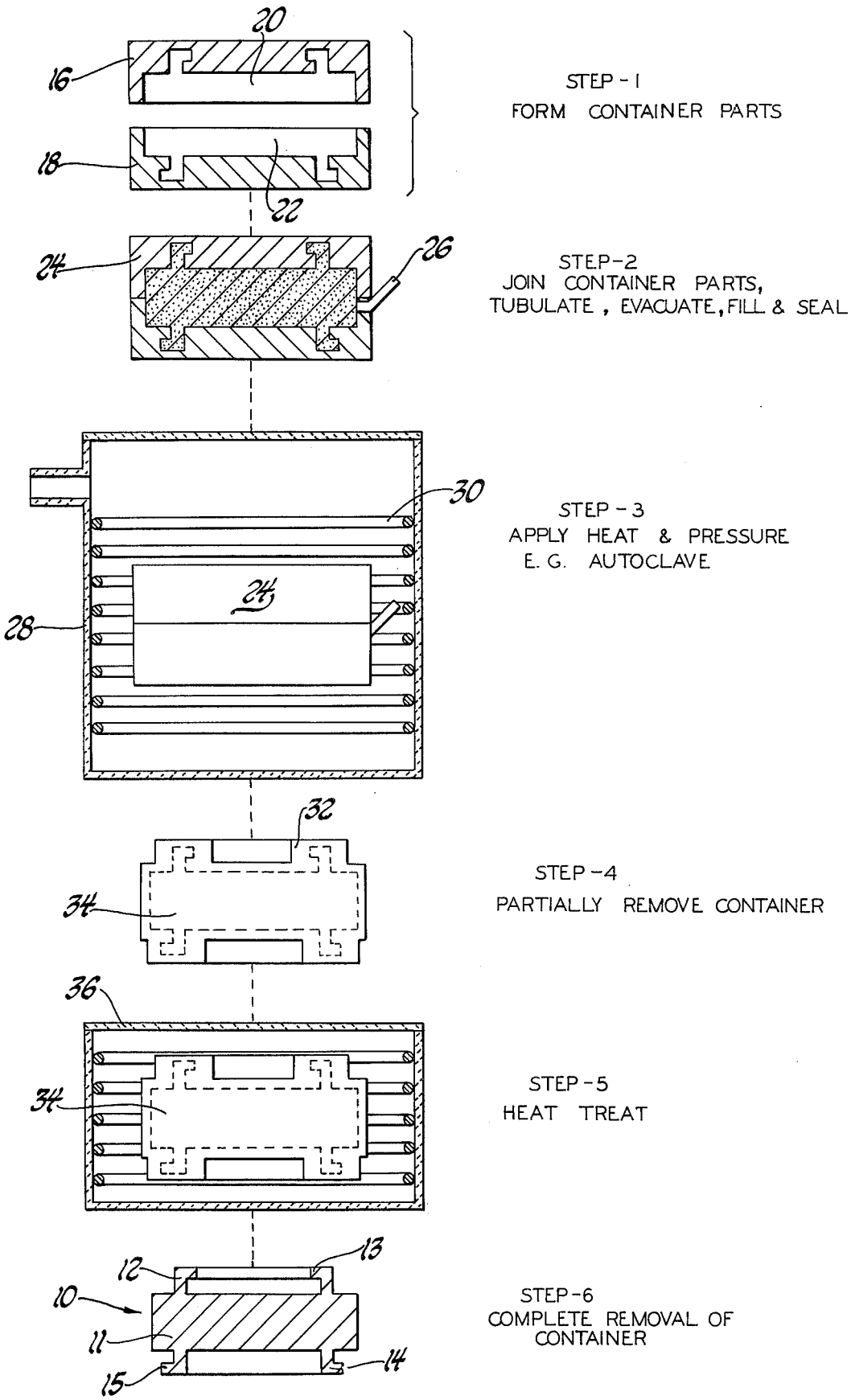
20
16
18
22
STEP - 1
FORM CONTAINER PARTS
24
26
STEP-2
JOIN CONTAINER PARTS,
TUBULATE, EVACUATE, FILL & SEAL
30
24
28
STEP - 3
APPLY HEAT & PRESSURE
E. G. AUTOCLAVE
32
34
STEP -4
PARTIALLY REMOVE CONTAINER
36
34
STEP -5
HEAT TREAT
13
12
10
11
15
14
STEP-6
COMPLETE REMOVAL OF
CONTAINER

METHOD OF FORMING AND SUBSEQUENTLY HEAT TREATING ARTICLES OF NEAR NET SHAPED FROM POWDER METAL

FIELD OF THE INVENTION

This invention relates to a method of forming and subsequently heat treating articles of near net shape from powder metal.

BACKGROUND OF THE INVENTION

The use of powder metallurgical techniques has become popular with high alloyed materials due to the problems encountered in casting such materials, e.g., segregation and resulting loss of physical properties. For example, powder metallurgical techniques are used extensively with nickel, cobalt, and ferrous-base superalloys. These are high temperature — high strength alloys used for making turbine discs, blades, buckets, and other components of jet engines which are subjected to high stress at mid-range or high temperatures. The very properties which make these alloys attractive for use in jet engines cause the consolidation of the powders to be difficult. Moreover, subsequent operations, such as forging and machining the resulting densified compact, to produce a final part are also difficult because of the high strength and toughness of these alloys.

Due primarily to the difficulties encountered in post-consolidation processing, efforts have been made to produce "near net shapes". As used herein, a near net shape is a densified powder metal compact having a size and shape which is relatively close to the desired size and shape of the final part. Heretofore, crude preforms have been produced which require extensive forming and machining to produce the relatively complex final part. Producing a near net shape reduces the amount of post-consolidation processing required to achieve the final part. For example, in many instances subsequent hot forging may be eliminated and the amount of machining required may be significantly reduced. Since these materials are difficult to machine, a reduction in the amount of machining offers a marked savings in tool and labor costs. Additionally, these materials are quite expensive, therefore, a reduction in machining results in a savings in material costs. Obviously, eliminating or reducing the amount of hot forging also offers savings advantages.

While the desirability of producing near net shapes has been recognized, many problems have been encountered in accomplishing this objective. The basic step of consolidating the metal powder to produce a powder metal compact having a near net shape has been a major obstacle. Once an acceptable near net shape is produced, other problems are presented. One of these relates to the heat treatment of the densified compact to achieve maximum physical properties.

Due to the fact that a near net shape is being produced, the configuration of the densified compact is relatively complex. Hence, the section size of the densified compact may vary greatly. As is well-known in the heat treating art, variations in section size may cause distortion and internal stresses in the densified compact due to differences in the rates of heating and cooling. The rate of heating also affects time at temperature which is determintive of the physical properties of the heat treated compact. Thinner sections, which reach temperature first, will be subjected to a longer holding period at temperture than thicker sections. This may result in significant, and most likely undesirable, differences in physical properties in various sections of the compact. For example, in an alloy strengthened by age hardening, overaging may occur in the thinner sections. Relative cooling rates are also critical in achieving a relatively uniform microstructure. Additionally, where heat treat temperatures approach the fusion temperature of the lowest melting constituent, the densified compact will become subject to deformation under relatively low stresses. Therefore, the densified compact is easily distorted. This problem is particularly acute in thinner sections which may deform under their own weight. Other problems associated with heat treating parts of complex shape should be immediately apparent to those knowledgeable in the art.

BRIEF DESCRIPTION OF THE INVENTION

This invention is directed to a method of forming and subsequently heat treating articles of near net shape from powder metal which offers unique solutions to many of the problems heretofore encountered. Generally, the method includes producing a thick-walled container from a mass of fully dense and incompressible material which is capable of plastic flow at elevated temperatures. The thick-walled container employed is disclosed in a co-pending U.S. patent application of the inventor herein, Ser. No. 692,310, filed June 3, 1976. A cavity of predetermined shape is formed in the mass of material such that the walls of the container are of sufficient thickness so that the exterior surface thereof does not closely follow the contour of the cavity. It has been found that this type of container is capable of producing near net shapes having surprisingly close dimensional tolerances with a minimum of distortion.

The cavity of the container is then filled with powder metal of desired composition. In some cases, the container is evacuated prior to filling to place the cavity under a vacuum. The container is then sealed. Heat and pressure are applied to the filled and sealed container whereby the container material acts like a fluid to apply hydrostatic pressure to the heated powder metal contained in the cavity thereby consolidating the powder metal to produce a densified compact. The densified compact is then prepared for heat treating by selectively removing portions of the container. As a general rule, less container material is removed from the regions surrounding thin sections than from the regions surrounding thicker sections. In this manner, the mass of the thinner sections are, in effect, increased by the container material. In this manner, the rate of heating and cooling can be adjusted. The container material helps to physically support the thinner sections at elevated temperatures to resist deformation. The modified container and densified compact combination are appropriately heat treated. During heat treating, the container material serves as a protective barrier to prevent surface contamination of the densified compact. After heat treating, the remaining container material is removed from the densified compact thereby producing a near net shape.

BRIEF DESCRIPTION OF THE DRAWING

Other advantages of the present invention will be readily appreciated as the same becomes better understood by reference to the following detailed description when considered in connection with the accompanying drawing which is a flow diagram illustrating the major steps involved in the method of the instant invention.

DETAILED DESCRIPTION OF THE INVENTION

The invention will be described with respect to a part made from Astroloy powder, a precipitation hardened nickel-base superalloy. The specific configuration of the part shown in the flow diagram is not intended to depict an actual production part, but is shown by way of example to illustrate a near net shape of relatively complex configuration. Similar shapes, however, are encountered in actual practice. It is to be recognized that other types of metal powder as well as other complex shapes may be produced in the manner disclosed herein.

As shown in Step 6 of the flow diagram, the desired near net shape, generally shown at 10, includes a disc-shaped body 11 having two annular rings 12 and 14, one of the rings extending from each side of the body. The upper ring 12 includes a radially inwardly extending flange 13 while the lower ring 14 includes a radially outwardly extending flange 15. It should be apparent that the annular flanges 13 and 15 define undercuts which are generally a source of serious forming problems.

In order to produce a near net shape having this configuration, a thick-walled container for consolidating the powder metal is produced. Generally, the container should be made from a mass of fully dense and incompressible material which is capable of plastic flow at elevated temperatures. In the case of Astroloy powder and other related powders, a suitable container material is low-carbon steel, such as an SAE 1008 or 1010 steel. Low-carbon steel offers the advantages of being relatively inexpensive, readily available, and easily removed from the densified compact by machining or pickling. Other considerations which make low-carbon steel a satisfactory material for the container are that Astroloy and low-carbon steel have reasonably close coefficients of thermal expansivity and no deleterious reactions will occur between the constituents of Astroloy and the low-carbon steel.

Referring to Step 1 of the drawing, a practical method for producing the container involves providing two disc-shaped pieces of steel 16 and 18. Appropriately dimensioned cavities 20 and 22 are machined in the two pieces of steel by standard machining techniques. The dimensions of the cavities are, of course, larger than the dimensions of the desired densified compact 10 to take into account the predicted amount of shrinkage which occurs as the powder densifies. While a two-piece container is shown, more complex parts may be produced by employing containers having three or more interfitting pieces. The sections 20 and 22 of the cavity are machined in the pieces of steel in a manner analogous to the fabrication of a closed die. Alternatively, the container may be cast using an expendable core to form the cavity.

In accordance with the disclosure in the aforementioned U.S. patent application Ser. No. 692,310 the container is "thick-walled". By way of definition, the exterior surface of a thick-walled container does not closely follow the contour of the cavity. This insures that sufficient container material is provided so that, upon the application of heat and pressure, the container material will act like a fluid to apply hydrostatic pressure to the powder in the cavity. It has been shown that the use of a thick-walled container produces a near net shape having close dimensional tolerances with a minimum of distortion.

As shown in Step 1 of the flow diagram, each of the container parts 16 and 18 are machined to produce cavities 20 and 22 of predetermined complex shape. After machining the cavities, care is taken to fully remove all contaminants, such as cutting fluids, oil and the like. This precaution is taken to prevent the formation of a barrier between the powder and the container material. It has been found desirable that during consolidation the material of the container and the powder metal form one dense mass wherein the Astroloy and the low-carbon steel are actually fused together at their interface. Cutting fluids and other contaminants will prevent this fusion.

As shown in Step 2, after the container parts 16 and 18 are machined and cleaned, they are joined together to form a complete container 24. This is done by a welding operation. Care is taken to produce a hermetic seal between the container parts 16 and 18 so that the container may be evacuated. Obviously, poor weldments produce leaks which would permit the introduction of contaminants into the container. Again, it is pointed out that this process is being described with respect to Astroloy powder, an alloy which is highly reactive to oxygen. Therefore, it is desirable throughout the processing that the Astroloy powder be maintained in an inert atmosphere and, finally, under a vacuum during densification. Other alloy powders, however, may not be as susceptible to contamination and hence these precautions may not be necessary.

In the process of joining the container parts 16 and 18, the container 24 is tubulated. This is done by drilling a hole in one of the container parts for positioning a fill tube 26 which communicates with the cavity. The fill tube 26 is joined to the container part by welding. Again, care is taken to produce a hermetic seal. The container is then evacuated by connecting the fill tube 26 to a vacuum pump (not shown). After the container has been pumped down to a vacuum level of generally less than 10 microns, the container is filled with Astroloy powder. Prior to filling the container, the Astroloy has been degassed and maintained under a vacuum. During filling, the container 24 is rotated and vibrated to insure complete filling of the cavity to maximum tap density. After the container 24 has been completely filled with powder metal, the container is leak tested. Leak testing is done by measuring the rate of loss of the vacuum in the container. A decrease in vacuum of only a few microns per hour indicates that the container is properly sealed. After leak testing, the container is sealed by crimping and welding the fill tube 26.

At this point, the filled and sealed container is ready for the densification step. Densification of the powder metal is accomplished by heating and applying pressure to the container. Heat and pressure may be applied by using an autoclave or a hot forging press. Step 3 of the flow diagram is a schematic of an autoclave which includes a pressure vessel 28 and heating coils 30. When using an autoclave, the container 24 and contents are heated to a temperature of approximately 2050° F and a pressure of 15,000 psi is applied for 2 hours. Alternatively, the container 24 may be preheated in a furnace and transferred to a forging press. In order to apply pressure, the container is restrained in a restraining ring or cavity. In the case of either an autoclave or forging press, an isostatic pressure is applied to the exterior surface of the container 26. With regard to an autoclave, isostatic pressure is applied by the pressure medium, usually an inert gas, such as argon. Isostatic pressure is also produced in the forging press by employing the restraining ring or cavity. It is to be remembered that, at the densification temperatures employed, the low-carbon steel flows readily under the applied pressures. Hence, even though the ram of the press applies a one-directional force, the container material acts like a fluid and fills the retaining cavity and reacts with an essentially equal force against all sides, ignoring the weight of the container material which is small compared to the applied force.

Applying heat and pressure to the container in the manner described causes the container material to act like a fluid thereby applying a hydrostatic pressure to the heated powder metal contained in the cavity. Since the powder contained in the cavity is not at full density, the size of the cavity will decrease. The decrease in size of the cavity can be compared to the behavior of a gas bubble in a liquid under pressure. As the pressure is increased, the hydrostatic pressure on the walls of the bubble causes the diameter of the bubble to decrease. As the bubble decreases in size the gas in the bubble is compressed. The powder in the cavity is analogous to the gas in the bubble. The powder is compressed until it reaches full density. At the temperatures and pressures involved, the container material will actually fuse with the powder thus producing a unitary mass. A small diffusion zone is produced at the interface between the container material and the densified compact. This diffusion zone is very small and is normally limited to two atomic diameters.

After hot compaction, the container is removed from the autoclave 20 or forging press and allowed to cool.

The next step, Step 4 of the flow diagram, involves preparing the densified compact for heat treatment. This is done by partially removing portions of the container material in a selective and predetermined manner. As is apparent in the drawing, the body 11 of the densified compact 10 has a significantly larger section size than the rings 12 and 14. As pointed out above, variations in section size causes problems during heat treatment not only due to distortion of the densified compact, but also in the attainment of uniform physical properties. By using the thick-walled container described a unique solution to the heat treating problems is offered.

Selectively removing portions of the container facilitates the attainment of uniform physical properties and to reduce distortion. As a general rule, a greater amount of container material is removed from those regions adjacent thick sections than in those regions adjacent thinner sections. Hence, a jacket 32 of container material having varying thickness is retained on the densified compact. The jacket 32 of container material reduces the extent of variation in the section thickness of the densified compact by increasing the size of those sections. As a result, a heat treatable body 34 is produced which is a composite of the densified compact and the jacket of container material. Since the jacket of container material is expendable, attention is focused on achieving the desired physical properties in the densified compact without distortion due to internal stresses or sagging.

In this manner, the container material can be employed as a metallurgical tool for reducing or eliminating many of the problems encountered in heat treating near net shapes. It should be apparent, that although the heat transfer properties of Astroloy and low-carbon steel are different, a proper balance can be arrived at to produce the required heating and cooling rates in the various sections of the densified compact. As a result, distortion caused by internal stresses created during nonuniform cooling can be eliminated. Additionally, a uniform microstructure can be produced throughout the densified compact. A result which heretofore has been impossible to achieve due to the difference in the rates of cooling between small and large sections. An additional advantage is that the jacket of container material physically supports thin sections to prevent sagging.

The heat treatment is illustrated schematically in Step 5 which shows the heat treatable body 34 positioned within a furnace 36. By way of example, a typical heat treatment for a part made of Astroloy is described below. The densified compact is first solution treated. The solution temperature varies with the intended application of the part. However, a typical solution treatment includes an initial heating to 1975 - 2075° F for four hours. This is followed by an oil quence. It is noted that a relatively severe quench can be employed due to the fact that the jacket of container material promotes a relatively uniform cooling rate regardless of the variation in section size in the densified compact. Heretofore, without the jacket of container material it would have been necessary to employ a slower quench, such as a molten salt quench, to avoid internal stresses in the densified compact. The densified compact then undergoes a stabilization heat treatment which involves heating to 1600° F for eight hours followed by an air cool and a second heating to 1800° F for four hours followed by an air cool. The densified compact then undergoes a precipitation treatment by heating to 1200° F for twenty-four hours to precipitate a fine gamma prime phase (an $A_3B$ compound where "A" is nickel, cobalt, or iron and "B" is aluminum, titanium, or columbium). This is followed by an air cool and a second heating to 1400° F for 8 hours to coarsen some of the gamma prime phase. This heat treatment is then followed by an air cool.

The jacket of container material offers a significant advantage during the critical cooling stages. Because the jacket of container material has eliminated large variations in section size, all sections of the densified compact cool at approximately the same rate. Hence, a relatively uniform microstructure is produced. A uniform cooling rate also prevents the development of internal stresses. Additionally, the jacket of container material protects the densified compact to prevent any possible contamination during the heat treat process.

After heat treating, the jacket of container material is removed from the densified compact. This may be accomplished by etching in a suitable acid bath. The etchant removes the ferrous base metal, but will not attack the nickel base metal. After etching the densified compact may be grit-blasted to remove any residue. Alternatively, the jacket of container material may be removed by machining.

While the container material is sacrificed in the process described, it is pointed out that the cost of low-carbon steel is a fraction of the cost of superalloy powder such as Astroloy.

The near net shape shown in Step 6 is then ready for further processing, typically, final machining. It should be apprent, however, that a significant number of previously required intermediate steps have been eliminated by producing a near net shape. Moreover, problems associated with producing and heat treating a near net shape have been reduced.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein and yet remains within the scope of the appended claims.

The embodiments of the invention in which an exclusive property or privilege is claimed are defined as follows:

1. A method of forming and subsequently heat treating articles of near net shape from powder metal including the steps of producing a thickwalled container by forming a cavity of predetermined shape in a mass of suitable container material such that the walls of the container are of sufficient thickness so that the exterior surface thereof does not closely follow the contour of the cavity, filling the cavity of the container with powder metal, and applying heat and pressure to the container such that the container material acts like a fluid to apply hydrostatic pressure to the heated powder metal contained in the cavity thereby consolidating the powder metal to produce a densified compact; the improvement comprising the steps of preparing the densified compact for heat treating by selectively removing portions of the container to form a jacket of container material around the densified compact, heat treating the densified compact and completing removal of the container material.

2. The method as set forth in claim 1 wherein preparing the densified compact for heat treating by selectively removing portions of the container is further defined as forming a jacket of container material having a varying thickness, the thickness of the jacket being generally greater in regions adjacent thin sections of the densified compact than in regions adjacent thicker sections.

3. The method as set forth in claim 1 wherein the step of applying heat and pressure to the container is further characterized as applying isostatic pressure to the container.

4. The method as set forth in claim 1 wherein producing a thick-walled container is further defined as producing a thick-walled container from metallic-base material.

5. A method of forming and subsequently heat treating near net shapes from superalloy powder metal including the steps of producing a thickwalled container from a mass of fully dense and incompressible ferrous-base material by forming a complex cavity of predetermined shape in the mass such that the walls of the container are of sufficient thickness so that the exterior surface thereof does not closely follow the contour of the cavity, filling the cavity of the container with a powder metal selected from a group consisting of nickel, cobalt, and ferrous-based superalloy powder and consolidating the powder metal by heating the container and powder metal to a temperature at which the powder metal will consolidate and by applying pressure to the heated container sufficient to cause plastic flow of the ferrous-base container material whereby the container material acts like a fluid to apply hydrostatic pressure to the heated powder metal contained in the cavity thereby consolidating the powder metal to produce a densified compact; the improvement comprising the steps of preparing the densified compact for heat treating by selectively removing portions of the container to form a jacket of container material around the densified compact, heat treating the densified compact and completing removal of the container material.

6. A method for heat treating a powder metal compact which has been consolidated in a thick-walled container comprising the steps of preparing the consolidated compact for heat treating by selectively removing portions of the thickwalled container to form a jacket around at least portions of the compact, heat treating the compact, and completing removal of the container material.

* * * * *